US006514071B1

(12) United States Patent
Meyer

(10) Patent No.: US 6,514,071 B1
(45) Date of Patent: Feb. 4, 2003

(54) EMITTER APPARATUS

(76) Inventor: Jens-Uwe Meyer, 2727 N. Highway AIA #501, Indialantic, FL (US) 32903

( * ) Notice: Subject to any disclaimer, the term of this patent is extended or adjusted under 35 U.S.C. 154(b) by 0 days.

(21) Appl. No.: 10/205,155

(22) Filed: Jul. 25, 2002

Related U.S. Application Data

(60) Provisional application No. 60/315,729, filed on Aug. 29, 2001.

(51) Int. Cl.[7] ..... F23D 14/14

(52) U.S. Cl. ..... 431/328; 431/326; 126/92 AC

(58) Field of Search ..... 431/7, 326, 328, 431/329, 100; 126/92 AC, 92 R, 92 B

(56) References Cited

U.S. PATENT DOCUMENTS 3,407,023 A * 10/1968 Hirschberg et al. ..... 431/328
3,785,763 A * 1/1974 Bratko ..... 431/328
4,035,132 A * 7/1977 Smith ..... 431/328
4,272,237 A * 6/1981 Smith ..... 431/328
4,492,564 A * 1/1985 Wold ..... 431/328
4,666,400 A * 5/1987 Vigneau ..... 431/328
5,360,490 A * 11/1994 Nelson ..... 431/328
6,007,329 A 12/1999 Meyer
6,033,211 A 3/2000 Meyer
6,190,162 B1 * 2/2001 Smith et al. ..... 431/328

* cited by examiner

*Primary Examiner*—James C. Yeung
(74) *Attorney, Agent, or Firm*—Greenwald & Basch LLP; Howard J. Greenwald

(57) ABSTRACT

A gas-fired infrared radiation emitter with a frame, a screen removably attached to the frame, and a device for locking the screen to the frame. At least three receptacles are connected to each side of the frame, and at least one support is connected to each end of the frame. Three retaining bars extend from one side of the frame to the other and are used to lock secure the screen between such bars and the frame; and a fourth retaining bar extends from one end of the frame to the other and also secures the screen.

18 Claims, 4 Drawing Sheets

EMITTER APPARATUS

CROSS-REFERENCE TO RELATED PATENT APPLICATION

This patent application claims priority based upon applicant's provisional patent application No. 60/315,729, filed on Aug. 29, 2001.

FIELD OF THE INVENTION

A gas fired infrared radiation emitter with improved durability.

BACKGROUND OF THE INVENTION

U.S. Pat. No. 6,007,329, the entire disclosure of which is hereby incorporated by reference into this specification, describes and claims: "A gas fired infrared radiation emitter comprising: a back-body provided with a distributor for distributing a fuel-oxygen containing gas mixture; a primary radiator having a combustion surface; a frame receiving at least partly said primary radiator and connecting said back-body with said primary radiator, wherein said frame is comprised of a first end and a second end, wherein said first end of said frame is comprised of a first receptacle and a second receptacle integrally connected to said first end of said frame, and wherein said second end of said frame is comprised of a third receptacle and a fourth receptacle integrally connected to said second end of said frame. The emitter also comprises a screen removably attached to said frame; and means for removably locking said screen to said frame, wherein said means for removably locking said screen to said frame is comprised of: a first bar removably disposed within said first receptacle and said third receptacle, and means for removably connecting said first bar to said first receptacle and said third receptacle, a second bar removably disposed within said second receptacle and said fourth receptacle, and means for removably connecting said second bar to said second receptacle and said fourth receptacle, wherein: each of said first bar and said second bar has a length which is no greater than the length of said frame, and said screen is removably locked between said frame, and each of said first bar and said said bar; means for allowing movement of said first bar towards said first end of said frame for at least about 0.15 inches, and means for limiting the amount of movement of said first bar towards said first end of said frame, means for allowing movement of said first bar towards said second end of said frame for at least about 0.15 inches, and means for limiting the amount of movement of said first bar towards said second end of said frame, means for allowing movement of said second bar towards said first end of said frame for at least about 0.15 inches, and means for limiting the amount of movement of said second bar towards said first end of said frame, means for allowing movement of said second bar towards said second end of said frame for at least about 0.15 inches, and means for limiting the amount of movement of said second bar towards said second end of said frame, means for removing said first bar from said first receptacle and said third receptacle, and means for removing said second bar from said second receptacle and said fourth receptacle."

The gas fired radiation emitter of United States patent has met with a reasonable degree of commercial success. However, during prolonged high-temperature usage of such emitter, the screens often sag and ultimately split, thereby causing damage to the substrates being dried as well as adversely affecting the operation of the emitter.

It is an object of this invention to provide an improved gas fired infrared radiation emitter that is more durable than the emitter of U.S. Pat. No. 6,007,329.

SUMMARY OF THIS INVENTION

In accordance with this invention, there is provided a gas fired infrared radiation emitter comprising: frame connecting said back-body with said primary radiator, wherein said frame is comprised of a first side and a second side, and a first end and a second end, wherein said first side of said frame is comprised of a first receptacle, a second receptacle and a third receptacle integrally connected to said side of said frame, and wherein said second side of said frame is comprised of a fourth receptacle, a fifth receptacle, and a sixth receptacle integrally connected to said second side of said frame. The frame is also comprised of a first upstanding support integrally connected to said first end of said frame, as well as a second upstanding support integrally connected to said second end of said frame. The emitter also comprises a screen removably attached to said frame, wherein said screen is contiguous with said first upstanding support and said second upstanding support; and the emitter also comprises means for removably locking said screen to said frame, wherein said means for removably locking said screen to said frame is comprised of: a first bar removably disposed within said first receptacle and said fourth receptacle, and means for removably connecting said first bar to said first receptacle and said fourth receptacle, a second bar removably disposed within said second receptacle and said fourth receptacle, and means for removably connecting said second bar to said second receptacle and said fourth receptacle, and a third bar removably disposed within said third receptacle and said sixth receptacle, and means for removably connecting said third bar to said third receptacle and said sixth receptacle; wherein: each of said first bar, said second bar, and said third bar is disposed less than about 0.2 inches above the top surface of said screen and has a length which is no greater than the width of said frame, and said screen is removably locked between said frame, and each of said first bar, said second bar, and said third bar. The emitter also includes means for allowing movement of said first bar, said second bar, and said third bar towards said first side of said frame for at least about 0.15 inches, and means for limiting the amount of movement of said first bar, said second bar, and said third bar towards said first end of said frame. A vertically-extending bar is disposed less than about 0.2 inches above screen and is removably connected to each of said first bar, said second bar, and said third bar.

BRIEF DESCRIPTION OF THE DRAWINGS

The invention will be described by reference to the following drawings, in which like numerals refer to like elements, and in which.

DESCRIPTION OF THE PREFERRED EMBODIMENTS

U.S. Pat. No. 6,007,329 describes an emitter onto whose frame four fixtures are welded to hold the retaining bars that hold the screen. The entire disclosure of this United States patent is hereby incorporated by reference into this specification.

By comparison, the "frame" described in this patent application does not require the welding of any fixtures. Instead, when the frame is made, the "retaining bar holders" are bent up and thus are an integral part of the assembly.

Figure 1:
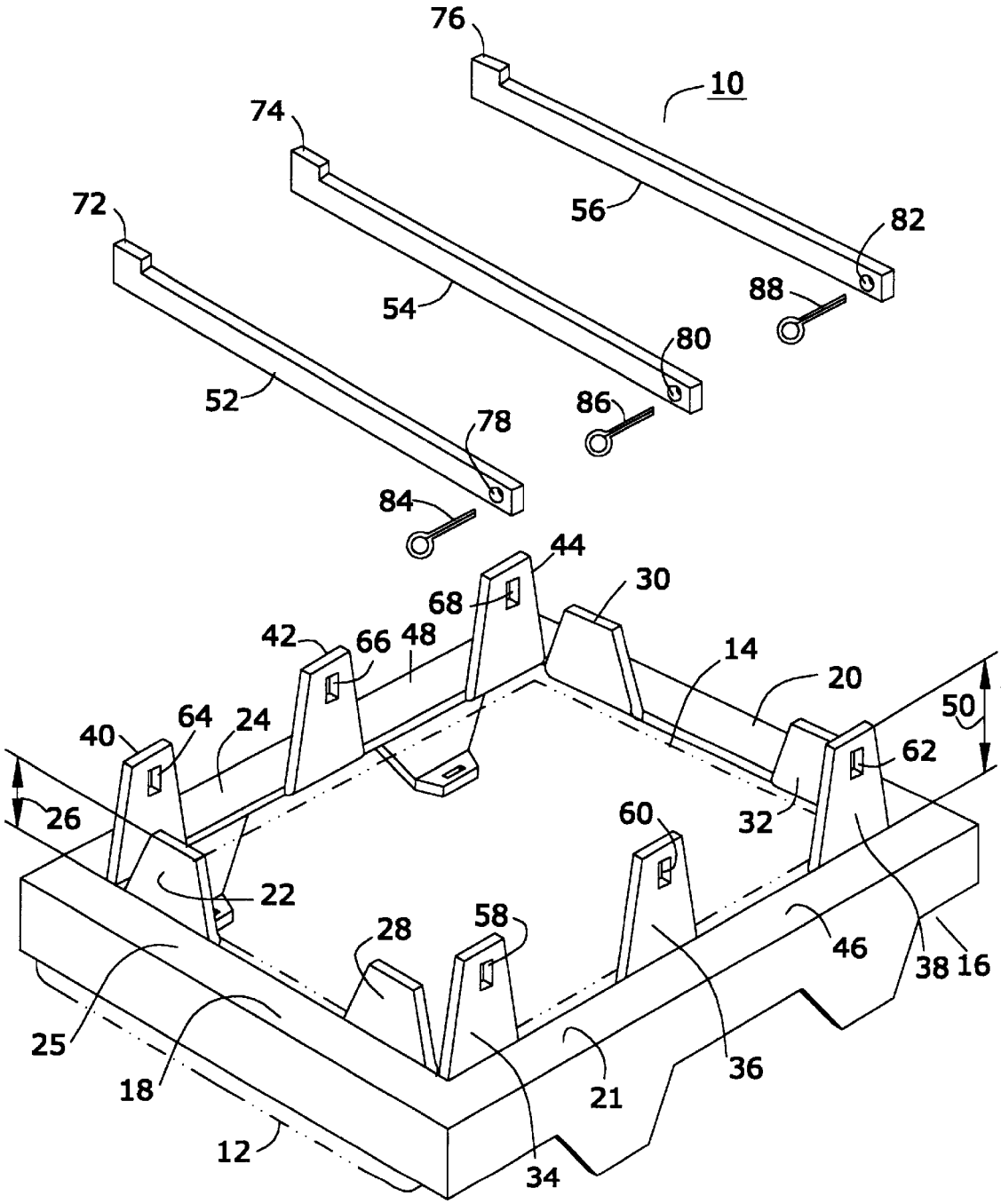
FIG. 1 is a partial exploded view of one preferred emitter of this invention.

FIG. 1 is a partial exploded view of a gas-fired infrared radiation emitter 10. Emitter 10 is comprised of a back body 12. This back body 12 is provided with a distributor (not shown) for distributing a fuel-oxygen containing gas mixture (not shown); and it is substantially identical to the back body 28 depicted in FIG. 2 of U.S. Pat. No. 6,007,329.

Referring again to FIG. 1, the emitter 10 is comprised of a distributor 14 for distributing the fuel-oxygen containing gas mixture. The distributor 14 is preferably substantially identical to the distributor 32 depicted in FIG. 2 of U.S. Pat. No. 6,007,329.

The emitter 10 also is comprised of a frame 16. This frame 16 differs from the frame 12 depicted in U.S. Pat. No. 6,007,329.

Referring again to FIG. 1, it will be seen that frame 16 is comprised of a first end 18, a second end 20, a first side 21, and a second side 24.

Integrally connected to the first end 18 is a first vertically-extending support 22 integrally connected to the first end 18. This support 22 forms an angle with surface 25 of frame 18 of from about 70 to about 90 degrees; and it preferably has a height 26 of from about 0.2 to about 0.6 inches and, more preferably, from about 0.2 to about 0.5 inches.

As will be apparent, the support 22 is adapted to engage the emitter screen (not shown in FIG. 1) and to prevent it from moving longitudinally.

In the embodiment depicted in FIG. 1, there are two supports (supports 22 and 28) connected to the first end 18, and an additional two such supports (supports 30 and 32) connected to the second end 20 of the frame 16. In another embodiment, not shown, only one such support is connected to each of ends 18 and 20. In yet another embodiment, at least three such supports are connected to each of ends 18 and 20. In general, from about 1 to about 4 such supports are disposed on each of ends 18 and 2.

Referring again to FIG. 1, it will be seen that, in the preferred embodiment depicted, each of sides 21 and 24 has integrally connected to it a multiplicity rod holders 34/36/38, and 40/42/44, respectively.

In one embodiment, depicted in FIG. 1, each of the rod holders 34, 36, and 38 forms an angle with surface 46 of side 22 of from about 70 to about 100 degrees. Similarly, in this embodiment, each of rod holders 40, 42, and 44 also form an angle with surface 48 of side 24 of from about 70 to about 100 degrees.

Each of the rod holders 34, 36, 38, 40, 42, and 44 has a height 50 of at least 0.5 inches. In one embodiment, height 50 is from about 0.5 to about 1.3 inches. In another embodiment, height 50 is from about 0.8 to about 1.2 inches.

Each of the rod holders 34, 36, 38, 40, 42 and 44 is comprised of a slot adapted to receive a portion of one of the retaining bars 52, 54, 56. Thus, such holders comprised slots 58, 60, 62, 64, 66, and 68, respectively. In the embodiment depicted, each of such slots 58 et seq. is at least about 0.1 inches greater in all dimensions than the retaining bar it is adapted to receive.

Figure 2:
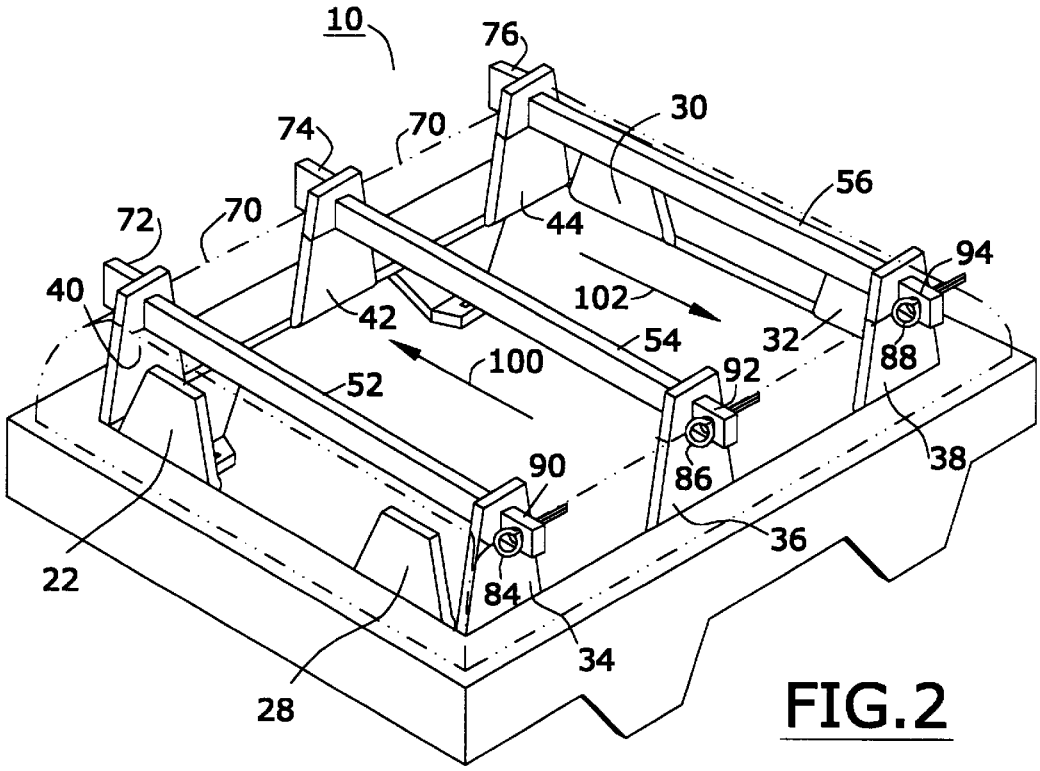
FIG. 2 is a partial perspective view of the emitter of FIG. 1.

FIG. 2 is a partial perspective view of the emitter 10 in which the screen 70 is shown in dotted line outline. The screen 70 is substantially identical in structure and function to the screen 14 illustrated in FIGS. 1 and 2 of U.S. Pat. No. 6,007,329.

As will be apparent, the supports 22 and 28 limit the extent to which screen 70 can move in one longitudinal direction, and supports 30 and 32 limit the extent to which the screen 70 can move in another longitudinal direction.

Similarly, the extent to which the retaining bars 52, 54, and 56 can move in the transverse direction also is limited. As will be seen from FIG. 2, and in the preferred embodiment depicted therein, each of the retaining bars 52, 54, and 56, is comprised of a stop 72, 74, and 76, respectively. Each of these stops 72, 74, and 76 is larger than its corresponding slots.

Referring again to FIGS. 1 and 2, and in the preferred embodiment depicted therein, it will be seen that each of the retaining bars 52, 54, and 56 also is comprised of an orifice 78, 80, and 82, respectively adapted to receive a locking device 84, 86, and 88, respectively. In the embodiment depicted, the locking device 84/86/88 is a cotter pin. As will be apparent, other locking devices and/or locking assemblies also may be used.

In the embodiment depicted in FIG. 2, each of end stops 72, 74, and 76 are contiguous with 40, 42, and 44; thus, there is a space 90, 92, and 94, respectively, between the supports 34, 36, and 38 and the locking device 84, 86, and 88. The lengths of bars 52, 54, and 56 are chosen such that the spaces 90, 92, and 94 are at least about 0.15 inches but preferably less than about 0.5 inches. A similar functional arrangement is present in U.S. Pat. No. 6,007,329.

In the position depicted in FIG. 2, each of bars 52, 54, and 56 is free to be moved in the direction of arrow 100 a distance of from about 0.15 to about 0.5 inches, until the locking device 84/86/88 contacts its respective rod holders 34/36/38. Thereafter, after such contact is made, each of the bars 52, 54, and 56 will be free to be moved in the direction of arrow 102 a distance of from about 0.15 to about 0.5 inches until the end stops 72/74/76 contacts its respective rod holder 40/42/44.

Thus, the device depicted in FIGS. 1 and 2 is comprised of ". . . means for allowing movement of said first bar towards said first side of said frame for at least about 0.15 inches, and means for limiting the amount of movement of said first bar towards said first side of said frame, means for allowing movement of said first bar towards said second side f said frame for at least about 0.15 inches, and means for limiting the amount of movement of said first bar towards said second side of said frame, means for allowing movement of said second bar towards said first side of said frame for at least about 0.15 inches, and means for limiting the amount of movement of said second bar towards said first side of said frame, means for allowing movement of said second bar towards said second side of said frame for at least about 0.15 inches, and means for limiting the amount of movement of said second bar towards said second side of said frame. Similar structure and functionality is provided for the third retaining bar.

In one embodiment, when the frame 16 is made, the retaining bar holders 34/36/38/40/42/44 are preferably bent up and are integrally attached to the frame 16, thereby obviating the need to weld such holders to the frame.

Referring again to FIGS. 2 and 3, and in the preferred embodiment depicted therein, the screen 70 preferably has a wire thickness of from about 1 to about 3 millimeters and, more preferably, about 1.5 millimeters. In the preferred embodiment depicted in the Figures, the screen 70 is bent all around (90 degrees downward bend) and rests on the outside edges of the rod holders 34/36/38/40/42/44.

Figure 3:
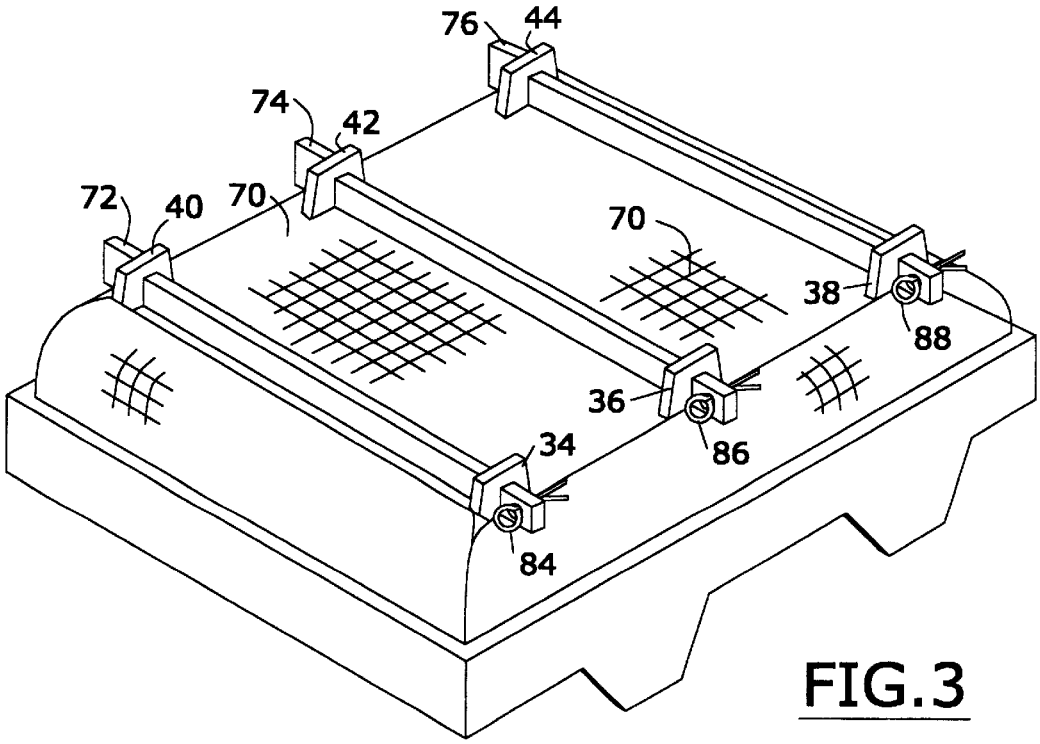
FIG. 3 is a complete perspective view of the emitter of FIG. 1.

In the embodiment depicted in FIG. 3, the rod holders 34/36/38/40/42/44 protrude through the screen 70. In order for the holders 34/36/38/40/42/44 to protrude through the screen 70 (so that the retaining rods 52/54/56 can be put across), two methods may be used. In one embodiment, slots are cut into the screen 70. In another embodiment, that portion of the screen 70 is simply cut away.

In one embodiment, a metal fiber mat, not shown, is the radiating medium in the emitter. Reference may be had, e.g., to element 34 of FIG. 2 of U.S. Pat. No. 6,007,329 which, in one embodiment thereof, is a mat of sintered metal fibers with a thickness of about 3.0 millimeters and a surface area of about 48 square inches.

Figure 4:
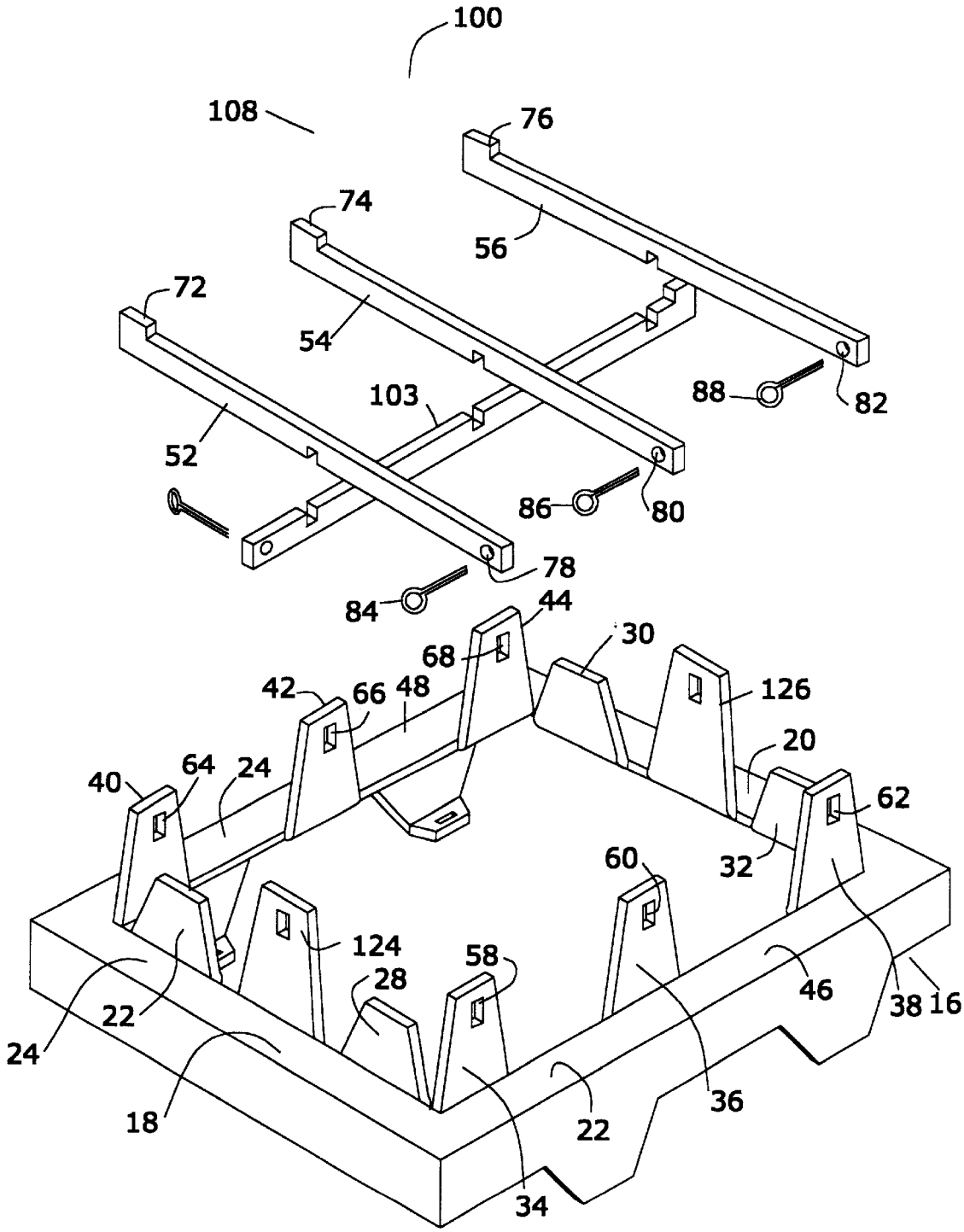
FIG. 4 is a partial exploded view of another preferred emitter of this invention.

FIG. 4 is a partial perspective view of emitter assembly 100 which is similar to the emitter assembly 10 (see FIG. 1) but differs therefrom in that a longitudinal retaining bar 103 is comprised of slots 110/112/114 which are adapted to engage with slots 116/118/120 (see FIG. 5) of transverse retaining bars 52/54/56 to produce the assembly 106.

Figure 5:
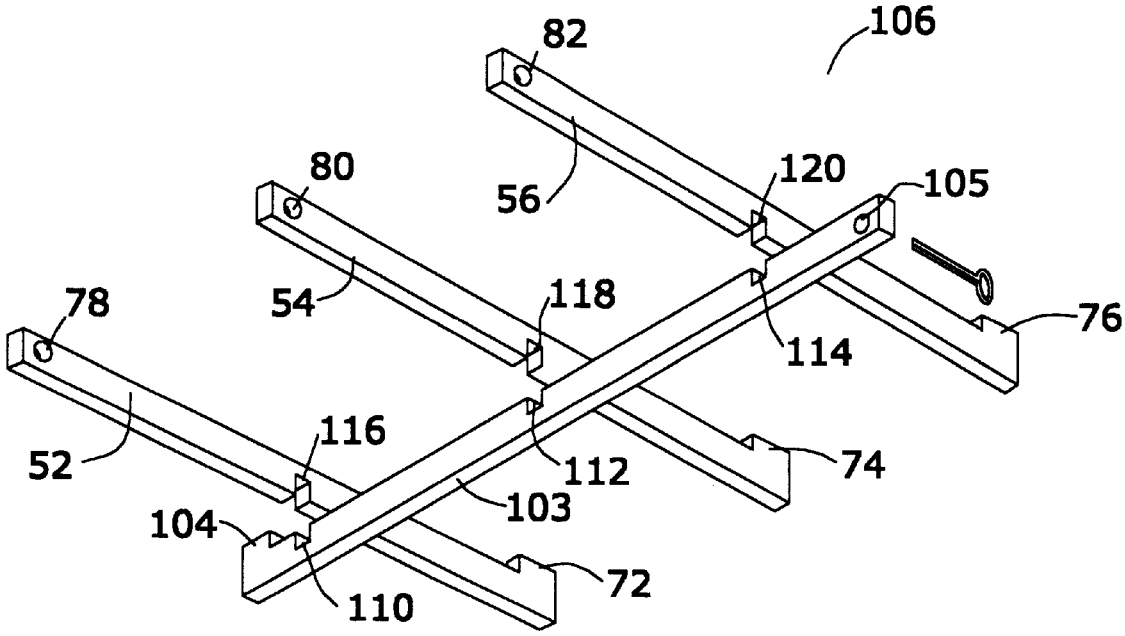
FIG. 5 is a partial exploded view of the retaining bar assembly of the emitter of FIG. 4. emitter of FIG. 4.

In the embodiment depicted in FIG. 5, the longitudinal bar is removably connected to the transverse retaining bars 52/54/56. An exploded view of the retaning bar assembly 106 is shown in greater detail in FIG. 5.

Referring to FIG. 5, and in the preferred embodiment depicted therein, it will be seen that the longitudinal retaining bar 103 is comprised of an end stop 104 and an orifice 105 that are adapted to be used with the rod holders 124 and 126 depicted in FIG. 4. As discussed elsewhere in this specification, in this embodiment, the movement of retaining bar 103 will be limited when the end stop 104 is contiguous with the rod holder 124, and the movement of the retaining bar 103 will also be limited when a locking device (such as, e.g., locking device 84) is contiguous with rod holder 126.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention Thus, in one embodiment, not shown, one can use up to six retaining rings that are spaced evenly across the screen 70 and attach the screen 70 to the retaining rods. These retaining rings can be tick welded to close after the connection of the screen 70 to the rod is made, or it can be some other type of locking mechanism. Preferably the retaining rings used will be of a thicker gauge than the screen in that these rings must last as least as long as the screen 70.

It will be apparent to those skilled in the art that there are substantial advantages to the instant assembly, when it is compared to the assembly of U.S. Pat. No. 6,007,329, a copy of which is attached. In the past, it has been expensive to fabricate the fixtures that were welded to the frame; and it was very difficult to properly align the fixtures and to put that complicated bend into the screen. This new assembly simply requires an approximately 90 degree bend all around for the screen, and it requires no welding; and alignment of the assembly is simple in that it is done during frame fabrication, usually employing laser cuts on automatic machines.

The emitter of the present invention is unexpectedly substantially superior to prior art emitters and substantially more durable. Tests have demonstrated that the emitter of the instant invention has a screen life that is at least about fifty percent greater than the screen life of the emitter of U.S. Pat. No. 6,007,329, when tested in high temperature drying environments.

I claim:

1. A gas-fired infrared radiation emitter, comprising a frame, a screen removably attached to said frame, and means for releasably locking said screen to said frame, wherein said frame is comprised of a first side, a second side, a first end, and a second end, and wherein:

(a) said first side of said frame is integrally connected to a first receptacle, a second receptacle, and a third receptacle;

(b) said second side of said frame is integrally connected to a fourth receptacle, a fifth receptacle, and a sixth receptacle;

(c) said first end of said frame is integrally connected to a first support, and said second end of said frame is integrally connected to a second support, wherein said screen is contiguous with said first support and said second support;

(d) said means for releasably locking said screen to said frame is comprised of a first bar removably disposed within said first receptacle and said fourth receptacle, a second bar removably disposed within said second receptacle and said fifth receptacle, and a third bar removably disposed within said third receptacle and said sixth receptacle, wherein each of said first bar, said second bar, and said third bar is disposed less than about 0.2 inches from said screen;

(e) said emitter further comprises means for allowing movement of said first bar, said second bar, and said third bar towards one of said first side and said second side for at least about 0.15 inches;

(f) said emitter further comprises means for limiting the movement of said first bar, said second bar, and said third bar towards one of said first side and said second side; and (g) said emitter further comprises a fourth bar extending between said first end and said second end, wherein said fourth bar is removably connected to said first bar, said second bar, and said third bar.

2. The emitter as recited in claim 1, wherein each of said first receptacle, said second receptacle, said third receptacle, said fourth receptacle, said fifth receptacle, and said sixth receptacle extend through said screen.

3. The emitter as recited in claim 2, wherein each of said first receptacle, said second receptacle, said third receptacle, said fourth receptacle, said fifth receptacle, and said sixth receptacle is comprised of an orifice.

4. The emitter as recited in claim 3, further comprising a third support integrally connected to said first end of said frame.

5. The emitter as recited in claim 4, further comprising a fourth support integrally connected to said second end of said frame.

6. The emitter as recited in claim 5, wherein said screen is contiguous with said third support and said fourth support.

7. The emitter as recited in claim 6, further comprising a seventh receptacle integrally connected to said first end of said emitter.

8. The emitter as recited in claim 7, further comprising an eighth receptacle integrally connected to said second end of said emitter.

9. The emitter as recited in claim 8, wherein said fourth bar is removably disposed within said seventh receptacle and said eighth receptacle.

10. The emitter as recited in claim 9, further comprising means for allowing movement of said fourth bar for at least about 0.15 inches.

11. The emitter as recited in claim 10, comprising first means for limiting the movement of said fourth bar.

12. The emitter as recited in claim 11, comprising second means for limiting the movement of said fourth bar.

13. The emitter as recited in claim 12, further comprising a back body.

14. The emitter as recited in claim 13, further comprising a distributor.

15. The emitter as recited in claim 14, wherein each of said first support, said second support, said third support, and said fourth support has a height of from about 0.2 to about 0.6 inches.

16. The emitter as recited in claim 15, wherein said orifice is a slotted orifice.

17. The emitter as recited in claim 16, wherein said emitter further comprises a multiplicity of end stops connected to said first bar, said second bar, said third bar, and said fourth bar.

18. The emitter as recited in claim 17, wherein each of said first bar, said second bar, said third bar, and said fourth bar is comprised of an orifice.

* * * * *